US007385482B2

(12) United States Patent
Wada

(10) Patent No.: US 7,385,482 B2
(45) Date of Patent: Jun. 10, 2008

(54) ELECTRO-OPTICAL DEVICE AND ELECTRONIC APPARATUS

(75) Inventor: Hiroshi Wada, Nagano (JP)

(73) Assignee: Seiko Epson Corporation (JP)

( * ) Notice: Subject to any disclaimer, the term of this patent is extended or adjusted under 35 U.S.C. 154(b) by 257 days.

(21) Appl. No.: 11/214,618

(22) Filed: Aug. 30, 2005

(65) Prior Publication Data

US 2006/0078138 A1 Apr. 13, 2006

(30) Foreign Application Priority Data

Sep. 28, 2004 (JP) ..... 2004-281115

(51) Int. Cl.
*G08B 3/00* (2006.01)

(52) U.S. Cl. ..... 340/384.1; 340/384.6; 340/384.7; 340/426.2; 340/473; 340/539.11; 455/575.1

(58) Field of Classification Search ..... 340/326, 340/384.1, 384.6, 384.7, 426.2, 426.21, 473, 340/539.11, 815.4, 815.5; 455/67.13, 566, 455/575.1, 575.4
See application file for complete search history.

(56) References Cited

U.S. PATENT DOCUMENTS 6,847,806 B2 * 1/2005 Curtis et al. ..... 455/90.3
6,950,680 B2 * 9/2005 Kela et al. ..... 455/566
7,010,121 B2 * 3/2006 Wennemer et al. .... 379/433.01
7,106,878 B2 9/2006 Saiki
7,147,351 B2 * 12/2006 Suzuki ..... 362/351

FOREIGN PATENT DOCUMENTS

| | | |
|---|---|---|
| JP | 08-168037 | 6/1996 |
| JP | 2002-063986 | 2/2002 |
| JP | 2003-078601 | 3/2003 |
| JP | 2003-111194 | 4/2003 |
| JP | 2003-158787 | 5/2003 |
| JP | 2003-179988 | 6/2003 |
| JP | 2004-336293 | 11/2004 |
| WO | WO 2004/004408 | 1/2004 |

* cited by examiner

*Primary Examiner*—Hung Nguyen
(74) *Attorney, Agent, or Firm*—Harness, Dickey & Pierce, P.L.C.

(57) ABSTRACT

An electro-optical device includes a display section that has a display region, a plurality of sound-production bodies that are disposed to overlap the display section and produce sound, and a first frame that is disposed between the display section and the sound-production bodies and holds the display section. The first frame forms air spaces for the plurality of sound-production bodies. In the first frame, sound-guiding paths and sound-releasing holes are formed to correspond to the plurality of sound-production bodies, respectively.

10 Claims, 9 Drawing Sheets

ELECTRO-OPTICAL DEVICE AND ELECTRONIC APPARATUS

RELATED APPLICATIONS

This application claims priority to Japanese Patent Application No. 2004-281115 filed Sep. 28, 2004 which is hereby expressly incorporated by reference herein in its entirety.

BACKGROUND OF THE INVENTION

1. Technical Field

The present invention relates to an electro-optical device, such as a liquid crystal display device or the like. Further, the invention relates to an electronic apparatus having such an electro-optical device.

2. Related Art

In recent years, electro-optical devices, such as a liquid crystal display device or the like, have been widely used for an electronic apparatus, such as a portable information terminal or the like. For example, in electronic apparatuses, electro-optical devices are used as display devices for displaying various kinds of information. Electro-optical devices are devices that control optical output states by an electrical input. For example, a liquid crystal display device, an electroluminescent (EL) device, a plasma display device, and other devices may be considered.

The above-described electro-optical device is primarily used to display various kinds of information as images in an electronic apparatus. In the electronic apparatus, a unit for producing sound needs to be provided, in addition to such an image display unit. For example, in a cellular phone, the content of a person's speech needs to be expressed by sound. Such a unit for producing sound is constituted by a sound-production body, such as a speaker or the like. An electronic apparatus having both the electro-optical device and the sound-production body has been known. Further, an electronic apparatus having a plurality of sound-production bodies has been known (for example, see Japanese Unexamined Patent Application Publication Nos. 2003-078601 and 2003-158787).

In electronic apparatuses according to the related art, the electro-optical device and the plurality of sound-production bodies are provided at different places in a case of the electronic apparatus. In this case, if the electro-optical device and the plurality of sound-production bodies are disposed to overlap each other in a thicknesswise direction of the electronic apparatus each other, the thickness of the electronic apparatus may be excessively increased. In recent years, the demand for the reduction in thickness of the electronic apparatus is increasing, and thus, in order to prevent the thickness of the electro-optical panel from being increased, it has been considered that the electro-optical device and the sound-production body are disposed not to overlap each other. In this case, however; the planar shape of the electronic apparatus is increased, and thus the electronic apparatus cannot be reduced in size.

Further, when the sound-production body is provided in the electronic apparatus, acoustic design in the vicinity of the sound-production body must be performed after the. electro-optical device is provided in the electronic apparatus. For this reason, the electronic apparatus cannot be reduced in size and thickness.

SUMMARY

An advantage of the invention is that it provides an electro-optical device and an electronic apparatus with a reduced thickness, when an electro-optical device having both a display section and a sound-production body is provided in an electronic apparatus.

According to a first aspect of the invention, an electro-optical device includes a display section that has a display region, a plurality of sound-production bodies that are disposed to overlap the display section and produce sound, and a first frame that is disposed between the display section and the sound-production bodies and holds the display section. The first frame forms air spaces for the plurality of sound-production bodies. In the first frame, sound-guiding paths and sound-releasing holes are formed to correspond to the plurality of sound-production bodies.

In the above-described configuration, the 'display section' can be constituted by any display unit. As such a display unit, a liquid crystal display device, an EL display device, a plasma display device, and other display devices can be used. Further, the 'sound-production body' can be constituted by a speaker, for example. Further, the first frame can be made of plastic, a metal, or the like. Since the first frame forms the air spaces for the plurality of sound-production bodies, the first frame may have a complex shape. In such a case, the first frame is preferably formed by a resin molding method with plastic as a material.

According to the electro-optical device having the above-described configuration, the display section is held by the first frame, the first frame is disposed between the display section and the sound-production bodies, and the air spaces for the sound-production bodies are formed by the first frame in advance. Further, in the first frame, the sound-guiding paths and the sound-releasing holes are formed. For this reason, when the electro-optical device is assembled into an electronic apparatus, the display section, the first frame, and the sound-production bodies can be attached at a proper place in the electronic apparatus as a single unit. Therefore, the entire shapes of the electro-optical device and the electronic apparatus can be reduced in size and thickness, as compared to the case in which the display section and the sound-production body are assembled separately in the electronic apparatus.

Further, according to the electro-optical device, the air spaces, the sound-guiding paths, and the sound-releasing holes are formed by the first frame itself, and thus these parts do not need to be designed with respect to the electronic apparatus. For this reason, the design of the electronic apparatus can be simplified, and thus the entire shape of the electronic apparatus can be reduced in size and thickness. Further, in the electro-optical device, the plurality of sound-production bodies are used, and thus stereo sound can be outputted.

Next, in the electro-optical device according to the first aspect of the invention, it is preferable that the display section and the sound-production bodies be supported by the first frame, such that the display section, the first frame, and the sound-production bodies are integrally combined with one another. By doing so, the integrated structure of the electro-optical device can be implemented, without using a frame other than the first frame, and thus the electro-optical device can be further reduced in size.

Next, in the electro-optical device according to the first aspect of the invention, it is preferable that the first frame form both a first air space on the display section for the sound-production bodies and a second air space on an opposite side to the display section. By doing so, other members other than the first frame do not need to be used to form the air spaces for the sound-production bodies, and thus the electro-optical device can be further reduced in size.

Next, the electro-optical device according to the first aspect of the invention may further include a second frame that separately supports the sound-production bodies and the first frame. In this case, the display section, the first frame, and the sound-production bodies may be integrally combined with one another by the second frame. According to this configuration, the display section, the first frame, and the sound-production bodies are integrally combined with one another by the second frame, and thus a reliable integrated structure can be realized.

Next, in the electro-optical device according to the first aspect of the invention, it is preferable that the second frame form an air space on an opposite side to the display section in the air spaces for the plurality of sound-production bodies. It is important for acoustic design that the air spaces are provided on both the display section and the opposite side to the display section with respect to the sound-production bodies. The air space on the display section of the air spaces is formed by the first frame. On the other hand, the air space on the opposite side to the display section can be formed by the second frame. When the second frame is not used, the air space can be formed by using components constituting the electronic apparatus. In this case, if the air space is formed by the second frame, which is a part of the electronic apparatus, any acoustic design does not need to be performed on the electronic apparatus, which has a significant advantage for the electronic apparatus.

Next, in the electro-optical device according to the first aspect of the invention, it is preferable that the second frame have a container shape that houses the display section, the first frame, and the sound-production bodies. By doing so, the integrated structure of the display section, the first frame, and the plurality of sound-production bodies can be drastically simplified, and thus a reliable integrated structure can be maintained.

Next, the electro-optical device according to the first aspect of the invention may further include a third frame that clamps the display section, the first frame, and the sound-production bodes in a pressed manner, together with the second frame. By doing so, the integrated structure of the display section, the first frame, and the sound-production bodies can be reliably maintained.

Next, in the electro-optical device according to the first aspect of the invention, it is preferable that the sound-production bodies be disposed on the rear side of the display section with the first frame interposed therebetween. By doing so, display of the display section can be easily viewed. Further, the electro-optical device can be reduced in size, as compared to the case in-which the sound-production body is provided at a horizontal position of the display section.

Next, in the electro-optical device according to the first aspect of the invention, it is preferable that the sound-releasing holes open at the same surface as the display region of the display section. By doing so, an observer who views display can easily hear sound.

Next, in the electro-optical device according to the first aspect of the invention, it is preferable that some of the plurality of sound-production bodies be disposed to overlap one another. By doing so, the size in a widthwise direction of the electro-optical device can be reduced. Further, all the plurality of sound-production bodes may be disposed to overlap one another. By doing so, the size in the widthwise direction of the electro-optical device can be further reduced.

Next, according to a second aspect of the invention, an electronic apparatus includes an electro-optical device having the above-described configurations, and a fixed member to which the electro-optical device is attached.

In accordance with the second aspect of the invention, in the electro-optical device used for the electronic apparatus, the display section is held by the first frame, the first frame is disposed between the display section and the sound-production bodies, and the air spaces for the sound-production bodies are formed by the first frame in advance. Further, in the first frame, the sound-guiding paths and the sound-releasing holes are formed. For this reason, when the electro-optical device is assembled into the electronic apparatus, the display section, the first frame, and the sound-production bodies can be attached at a proper position in the electronic apparatus as a single unit. Therefore, the entire shape of the electronic apparatus can be reduced in size and thickness, as compared to the case in which the display section and the sound-production body are assembled separately into the electronic apparatus.

Further, according to the electro-optical device, the air spaces, the sound-guiding paths, and the sound-releasing holes are formed by the first frame itself, and thus these parts do not need to be designed with respect to the electronic apparatus. For this reason, the design of the electronic apparatus can be simplified, and thus the entire shape of the electronic apparatus can be reduced in size and thickness. Further, in the electronic apparatus, the plurality of sound-production bodies are used, and thus stereo sound can be outputted.

In the electronic apparatus according to the second aspect of the invention, it is preferable that the fixed member be a packaging case. By doing so, a member for attaching the electro-optical device to the electronic apparatus does not need to be newly prepared, which has an advantage for product costs.

BRIEF DESCRIPTION OF THE DRAWINGS

The invention will be described with reference to the accompanying drawings, wherein like numbers reference like elements, and wherein.

DESCRIPTION OF THE EMBODIMENTS

First Embodiment of Electro-Optical Device

Figure 1:
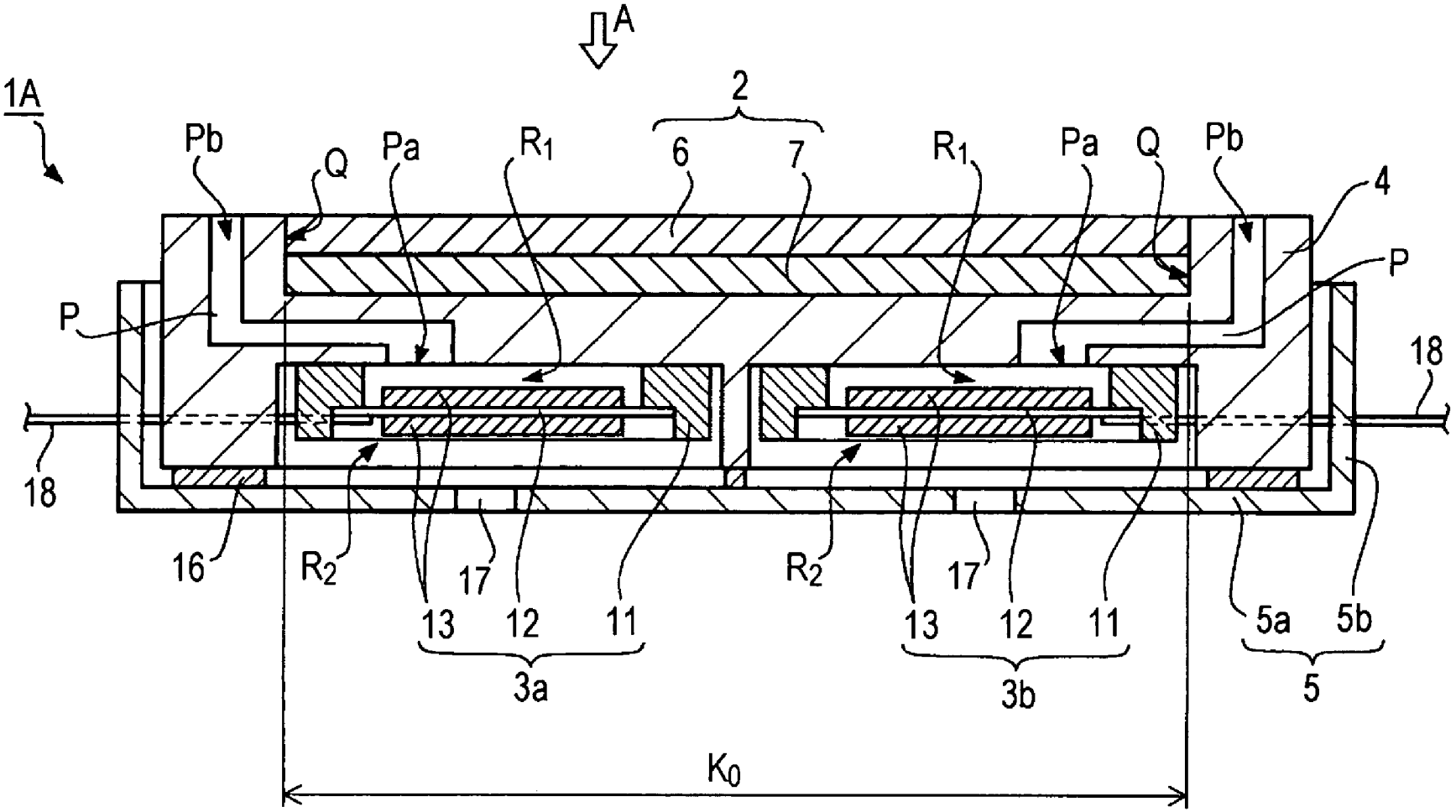
FIG. 1 is a cross-sectional view showing an electro-optical device according to an embodiment of the invention.

Hereinafter, an electro-optical device of the invention will be described by way of embodiments. Moreover, the embodiments described below are just examples of the invention and are not intended to limit the invention. Further, the following descriptions are given with reference to the drawings, if necessary. In the drawings, the scale of each part has been adjusted in order to have a recognized size, such that essential parts in a structure having a plurality of parts can be easily recognized.

Figure 2:
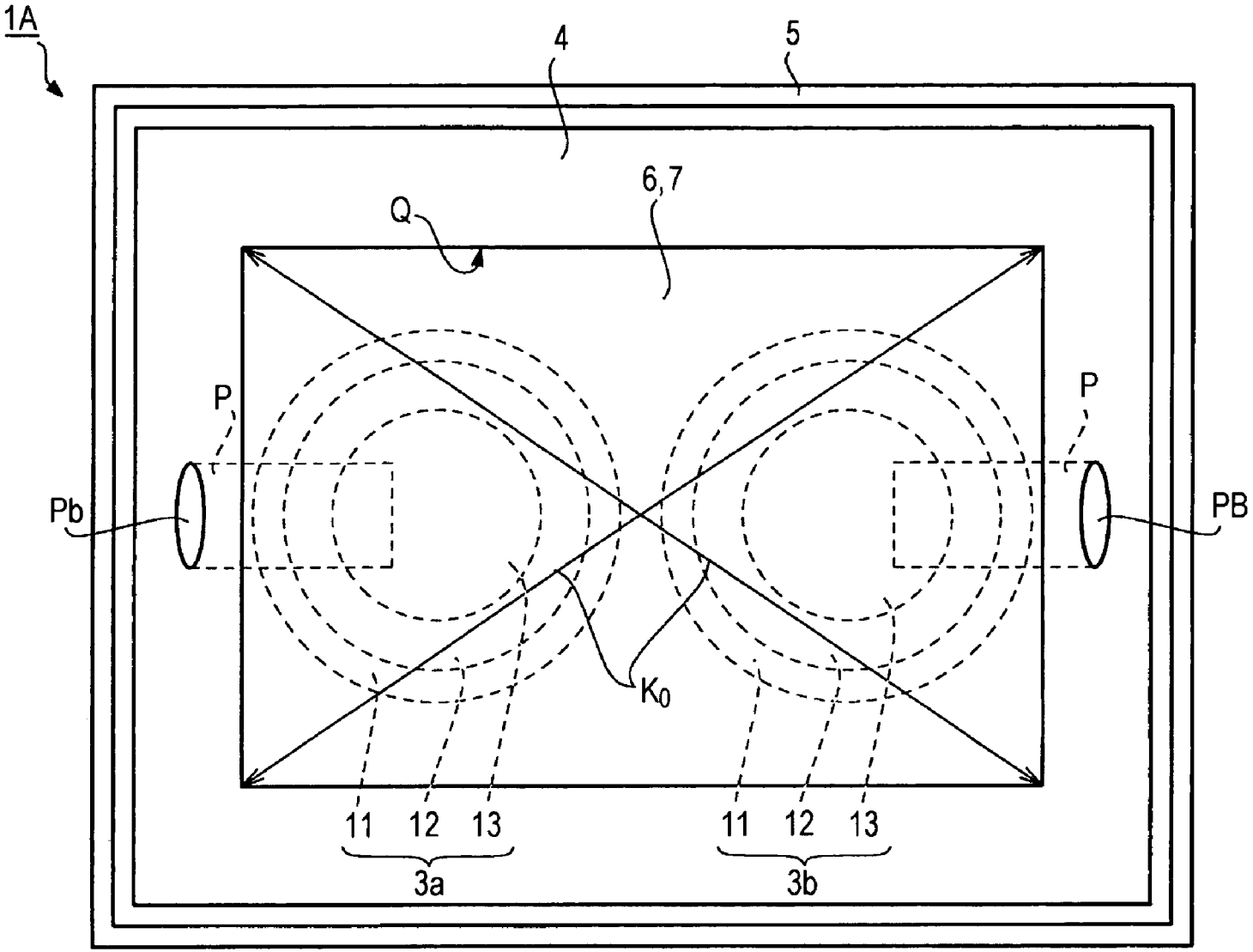
FIG. 2 is a plan view of the electro-optical device as viewed from an arrow A of FIG. 1.

FIG. 1 shows a sectional structure of an electro-optical device according to an embodiment of the invention. FIG. 2 shows a planar structure of the electro-optical device as viewed from an arrow A direction of FIG. 1. In FIGS. 1 and 2, an electro-optical device 1A has a liquid crystal display device 2 serving as a display section, speaker units 3*a* and 3*b* serving as sound-production bodies, a first frame 4, and a second frame 5. In the present embodiment, two speaker units 3*a* and 3*b* are provided, but three or more speaker units may be provided.

The liquid crystal display device 2 has a liquid crystal panel 6 serving as an electro-optical panel, and an illumination device 7 that is attached to the liquid crystal panel 6. The liquid crystal display device 2 displays various kinds of information on a display region of the liquid crystal panel 6 as images, such as characters, numerals, or figures. Display can be viewed by an observer from the arrow A direction. The illumination device 7 is disposed on a rear side of the liquid crystal panel 6 as viewed from an observation direction indicated by the arrow A and functions as a backlight. Moreover, the illumination device 7 may be disposed on an observation side of the liquid crystal panel 6 to function as a front light.

Though not shown in detail, the illumination device 7 has, for example, a plurality of light emitting diodes (LEDs) serving as light sources and a light guiding body. Then, light emitted from the LEDs is converted into planar light by the light guiding body and is supplied to the liquid crystal panel 6. Moreover, the light sources may be constituted by dot-shaped light sources or linear light sources, such as cold cathode tubes or the like.

Though not shown in detail, the liquid crystal panel 6 is formed, for example, by injecting liquid crystal between a pair of transmissive substrates, each having electrodes formed thereon. On outer surfaces of the pair of the substrates, polarizing plates of which polarizing axes are properly shifted are provided. When planar light is supplied from the illumination device 7 to the liquid crystal panel 6, a voltage to be applied to a pair of electrodes is controlled for each pixel to modulate light passing through liquid crystal. Then, modulated light passes through the polarizing plate, and thus images, such as characters, numerals, or figures, are displayed on a light emitting side of the polarizing plate.

The liquid crystal panel 6 can be constituted by any display mode. For example, as a liquid crystal driving method, a simple matrix method or an active matrix method may be used. Further, as a liquid crystal mode, a twisted nematic (TN) mode, a super twisted nematic (STN) mode, a liquid crystal mode having negative dielectric anisotropy, that is, a vertical alignment liquid crystal mode, and other liquid crystal modes can be used. Further, as an illumination method, a reflection type, a transmission type, or a transflective type can be used. Moreover, in the present embodiment, since the illumination device 7 is used, the transmission type or the transflective type is adopted as the illumination method.

The simple matrix method is a matrix method in which an active element is not provided for each pixel. In this case, intersections between scanning electrodes and data electrodes correspond to pixels or dots, and driving signals are directly thereto. As the liquid crystal mode with respect to this matrix method, the TN mode, the STN mode, or the vertical alignment mode is used. Next, the active matrix method is a matrix method in which an active element is provided for each pixel or dot. In this case, in a writing period, the active element is turned on, such that a data voltage is written into the pixel. In other periods, the active element is turned off, the voltage is held. As the active element used for this matrix method, a two-terminal type or a three-terminal type is exemplified. As the three-terminal-type active element, for example, a thin film transistor (TFT) is exemplified. Further, as the two-terminal-type active element, for example, a thin film diode (TFD) is exemplified.

In such a liquid crystal panel 6, at the time of color display, a color filter is provided on one of the pair of substrates. The color filter has a plurality of filters of B (blue), G (green), and R (red) of three primary colors. For example, these filters are arranged according to a predetermined arrangement, for example, stripe arrangement, a delta arrangement, or a mosaic arrangement, such that each of B (blue), G (green), and R (red) of three primary colors corresponds to each pixel.

As viewed from an observation side indicated by the arrow A, all the speaker units 3*a* and 3*b* fall within a spatial region K0 in a vertical direction of a surface on the display region of the liquid crystal panel 6. Then, the speaker units 3*a* and 3*b* are disposed on the rear side of the liquid crystal panel 6 to overlap the liquid crystal panel 6 as viewed from the observation direction indicated by the arrow A. For example, each of the speaker units 3*a* and 3*b* has a ring-shaped frame 11 made of aluminum (Al), a disc-shaped vibrator 12 that is integrally formed with the frame 11, and disc-shaped piezoelectric elements 13 that are fixed to the vibrator 12. Each of the speaker units 3*a* and 3*b* is supported on the first frame 4 by fixing the frame 11 to the bottom surface of the first frame 4 through adhesion or other fixing methods.

The first frame 4 is formed by, for example, resin molding to have a columnar shape or an angular plate shape in appearance. Then, first air spaces R1 are provided in the first frame 4 to come in contact with the surfaces of the speaker units 3*a* and 3*b*. The first air spaces R1 have columnar shapes or disc shapes. The first air spaces R1 are formed near the display section with respect to the speaker units 3*a* and 3*b*.

The first frame 4 has a rectangular concave portion Q on an upper end thereof as viewed from the arrow A direction, the illumination device 7 and the liquid crystal panel 6 are housed in the concave portion Q. The first frame 4 has two sound-guiding paths P therein. Each of the sound-guiding paths P has one end Pa that is connected to a portion of an upper end surface of the first air space R1 and the other end Pb that opens at a front surface, that is, an observation surface, of the first frame 4 to form a sound-releasing hole.

The second frame 5 has a rectangular bottom wall 5*a* as viewed from the arrow A direction and side walls 5*b* that extend from the bottom wall 5*a*. That is, the second frame 5 is formed to have a container shape. The second frame 5 is made of a metal, such as stainless steel or the like, and houses the liquid crystal panel 6, the first frame 4, the illumination device 7, and the speaker units 3*a* and 3*b* therein.

The first frame 4 is disposed on the bottom wall 5*a* of the second frame 5 via a buffing member 16. The buffing member 16 is made of an elastic material, such as resin, rubber, or the like. Spaces defined by the buffing member 16 between the bottom wall 5*a* and the speaker units 3*a* and 3*b* function as second air spaces R2. The second air spaces R2 are air spaces that are formed on an opposite side to the display section with respect to the speaker units 3*a* and 3*b*. Air inlets 17 are formed in portions of the bottom wall 5*a* that forms the second air spaces R2.

The speaker units 3*a* and 3*b* have conductive lines 18, correspondingly, through which sound signals are transmitted to the piezoelectric elements 13. The piezoelectric elements 13, which receive the signal, vibrate the vibrators 12, and sound corresponding to the sound signals is generated through the vibration and the interaction of the first and second air spaces R1 and R2. Then, sound is emitted to the outside via the sound-releasing holes Pb on the observation side indicated by the arrow A.

The electro-optical device 1A of the present embodiment can be placed on the market as the above-described structure of FIG. 1. When the electro-optical device 1A is assembled into an electronic apparatus, such as a cellular phone, a portable information terminal, an IC recorder, or the like, the second frame 5 may be fixed to a fixed member of the electronic apparatus, such as a case, a packaging case, or the like. Moreover, as shown in FIG. 1, if the air spaces R2 are formed on the opposite side to the display section by means of the second frame 5, any acoustic design does not need to be performed on the electronic apparatus, which has a significant advantage for the electronic apparatus.

Further, in the present embodiment, the speaker units 3*a* and 3*b* are fixed to a bottom'surface of the first frame 4, the liquid crystal display device 2 and the speaker units 3*a* and 3*b* are integrally supported by the first frame 4, without using the second frame 5. Therefore, the first frame 4 may be fixed to the fixed member of the electronic apparatus, without using the second frame 5. In this case, the second air spaces R2 are formed by any member of the electronic apparatus. As such, if the liquid crystal display device 2 and the speaker units 3*a* and 3*b* are integrally supported only by the first frame 4, without using the second frame 5, the electro-optical device can be further reduced in size.

Figure 3:
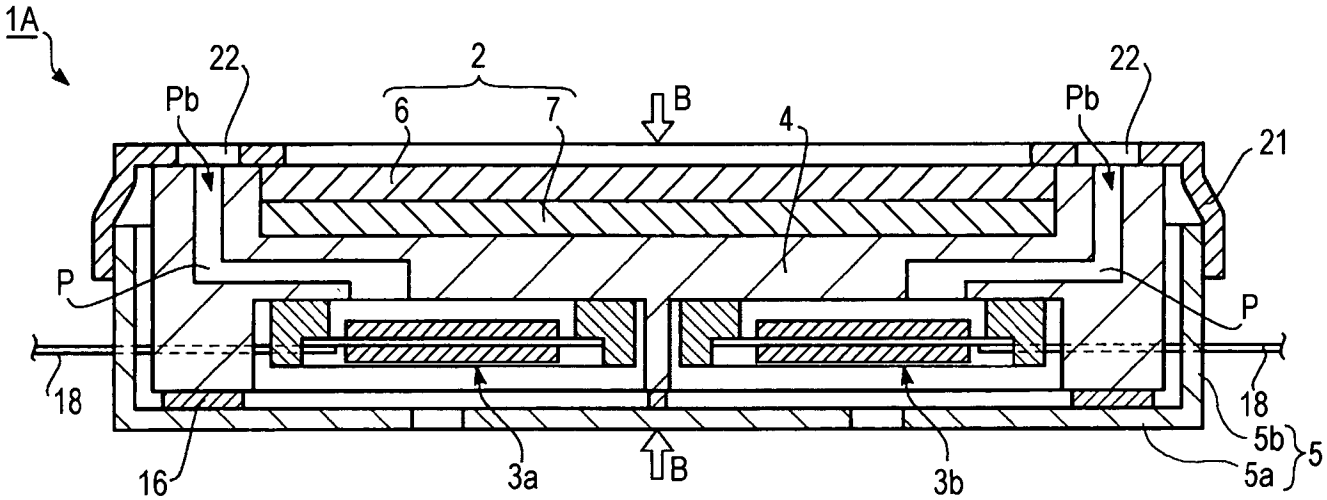
FIG. 3 is a cross-sectional view showing an example of the use of the electro-optical device shown in FIG. 1.

Further, in some cases, the electro-optical device 1A can be placed on the market as a structure shown in FIG. 3. The state shown in FIG. 3 is different from the structure shown in FIG. 2 in that a third frame 21 bonded to upper ends of the side walls 5*b* of the second frame 5 is provided. The third frame 21 is made of the same material as that of the second frame 5, that is, a metal, such as aluminum, stainless steel, or the like. The second frame 5 and the third frame 21 are bonded by an appropriate bonding method, for example, screw bonding, spot welding, press-fit bonding, caulking, or the like, in a state in which a predetermined pressure is applied from both sides. In such a manner, the liquid crystal display device 2, the first frame 4, and the buffing member 16 are housed between the second frame 5 and the third frame 21 in a biased state, that is, under stress. When the electro-optical device 1A of FIG. 3 is assembled into the electronic apparatus, the second frame 5 or the third frame 21 may be fixed to the fixed member of the electronic apparatus.

In portions of the third frame 21 corresponding to the sound-releasing holes Pb of the sound-guiding paths P provided in the first frame 4, openings 22 are preferably provided. Further, a transparent protective sheet (not shown) is preferably provided between the display section of the liquid crystal panel 6 and the third frame 21. Such a protective sheet may be made of light-transmissive plastic, for example. If the surface of the liquid crystal panel 6 is covered with the protective sheet, the liquid crystal panel 6 can be protected from mechanical damages.

The electro-optical device 1A according to the present embodiment has the above-described configuration, and thus various kinds of information can be displayed in the display region of the liquid crystal display device 2 as images. In addition, various kinds of information can be expressed as sound by means of the speaker units 3*a* and 3*b*. In FIG. 1, sound is generated in the speaker units 3*a* and 3*b*, passes through the sound-guiding paths P, and is transmitted to the outside from the sound-releasing holes Pb provided in the front surface of the first frame 4, that is, in the same surface as the display region of the liquid crystal panel 6. Since the speaker units 3*a* and 3*b* are plurally provided, stereo sound can be outputted.

According to the electro-optical device 1A of the present embodiment, the liquid crystal display device 2 serving as the display section, the first frame 4, and the speaker units 3*a* and 3*b* serving as the sound-production bodies are integrally combined with one another. At this time, the air spaces R1 near the display section for the speaker units 3*a* and 3*b* are formed in advance by means of the first frame 4. For this reason, when the electro-optical device 1A is assembled into the electronic apparatus, the electro-optical device 1A having the integrated structure can be simply attached at an appropriate place in the electronic apparatus. By doing so, the entire shape of the electro-optical device 1A can be reduced in size and thickness, as compared with the case in which the liquid crystal display device 2 and the speaker units 3*a* and 3*b* are assembled separately into the electronic apparatus.

Further, in the electro-optical device 1A of the present embodiment, all the two speaker units 3*a* and 3*b* are provided to fall within the spatial region K0 in the vertical direction on the display surface of the liquid crystal panel 6. Therefore, the speaker units 3*a* and 3*b* do not exist in a region in a horizontal direction of the liquid crystal panel 6. For this reason, the electro-optical device 1A can be reduced in size.

Further, in the electro-optical device 1A of the present embodiment, the second frame 5 that houses the liquid crystal display device 2, the first frame 4, and the speaker units 3*a* and 3*b* has the container shape. Therefore, the integrated structure of all of the liquid crystal display device 2, the first frame 4, and the speaker units 3*a* and 3*b* can be simplified. Further, a reliable integrated structure can be maintained.

Further, when the electro-optical device 1A of the present embodiment has the configuration shown in FIG. 3, that is, the third frame 21 is further provided to clamp the liquid crystal display device 2, the first frame 4, and the speaker units 3*a* and 3*b* in a pressed manner, together with the second frame 5, the integrated structure of the liquid crystal display device 2, the first frame 4, and the speaker units 3*a* and 3*b* can be reliably maintained.

Further, in the electro-optical device 1A of the present embodiment, the speaker units 3*a* and 3*b* are disposed on the rear side of the liquid crystal display device 2 with the first frame 4 interposed therebetween, and thus display of the liquid crystal display device 2 can be easily viewed. Further, the electro-optical device 1A can be reduced in size, as compared with the speaker units 3*a* and 3*b* are provided at the horizontal positions of the liquid crystal display device 2.

Further, in the electro-optical device 1A of the present embodiment, the sound-guiding paths P that guide sound generated in the speaker units 3*a* and 3*b* are provided in the first frame 4, and thus places (that is, the sound-releasing holes Pb) from which sound from the speaker units 3*a* and 3*b* is emitted to the outside can be selected unlimitedly. In particular, the sound-releasing holes Pb may be provided in the same surface as the display region of the liquid crystal display device 2. As such, if the sound-releasing holes Pb are provided in the same surface as the display region of the liquid crystal display device 2, an observer who views display can easily hear sound.

Further, in the electro-optical device 1A of the present embodiment, the two speaker units 3*a* and 3*b* are planarly arranged. For this reason, stereo acoustic effect can be increased.

Second Embodiment of Electro-Optical Device

Figure 4:
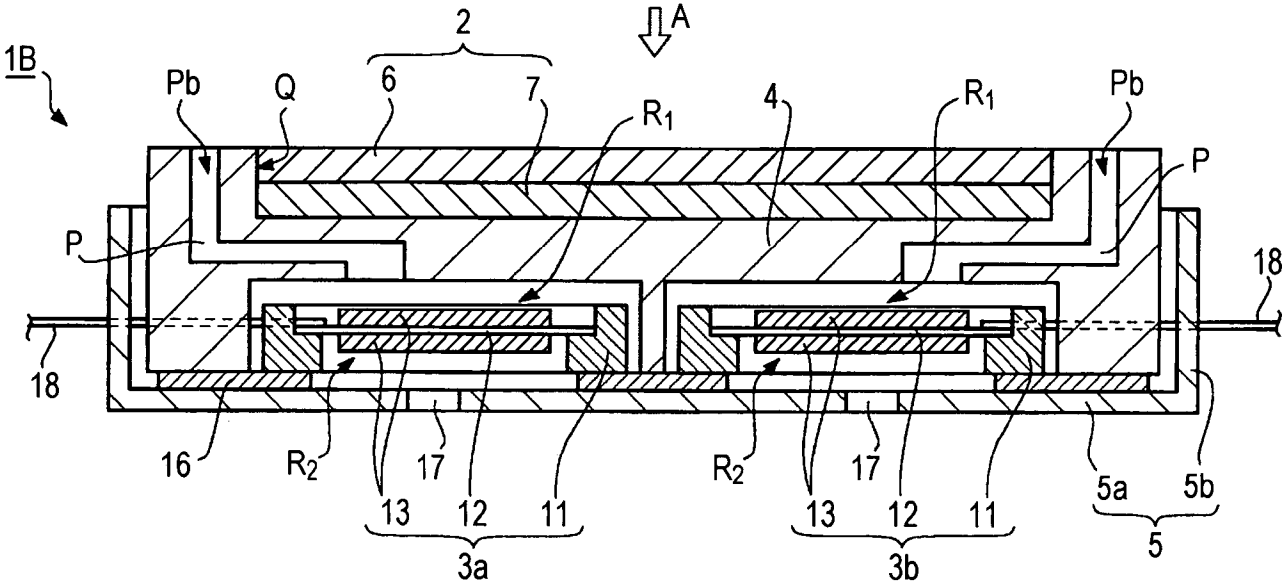
FIG. 4 is a cross-sectional view showing an electro-optical device according to another embodiment of the invention.

FIG. 4 shows an electro-optical device according to another embodiment of the invention. In the electro-optical device 1A shown in FIG. 1, the two speaker units 3*a* and 3*b* serving as the sound-production bodies are fixed to the first frame 4. On the contrary, in an electro-optical device 1B shown in FIG. 4, the frames 11 of the two speaker units 3*a* and 3*b* are fixed to the bottom wall 5*a* of the second frame 5, such that the speaker units 3*a* and 3*b* are supported by the second frame 5. That is, the first frame 4 supports the liquid crystal display device 2 serving as the display section, and the second frame 5 supports the speaker units 3*a* and 3*b* and the first frame 4 separately.

Moreover, the planar structure of the electro-optical device 1B as viewed from the arrow A direction is the same as the planar structure shown in FIG. 2. Further, in FIG. 4, the same parts as those in the embodiment of FIG. 1 are represented by the same reference numerals, and thus the descriptions thereof will be omitted.

In the electro-optical device 1A of FIG. 1, the structure in which both of the liquid crystal display device 2 serving as the display section and the speaker units 3*a* and 3*b* are supported by the first frame 4. Then, when the liquid crystal display device 2, the first frame 4, and the speaker units 3*a* and 3*b* are integrally combined with one another, the second frame 5 does not need to be provided. On the contrary, in the electro-optical device 1B shown in FIG. 4, the speaker units 3*a* and 3*b* are supported by the second frame 5, and thus, when the liquid crystal display device 2, the first frame 4, and the speaker units 3*a* and 3*b* are integrally combined with one another, the second frame needs to be provided.

In the electro-optical device 1B of the present embodiment, since the liquid crystal display device 2, the first frame 4, and the speaker units 3*a* and 3*b* are integrally combined with one another by means of the second frame 5, a more reliable integrated structure can be achieved, as compared with the case in which the liquid crystal display device 2 and the speaker units 3*a* and 3*b* are supported by the first frame 4 interposed between the liquid crystal display device 2 and the speaker units 3*a* and 3*b*.

Third Embodiment of Electro-Optical Device

Figure 5:
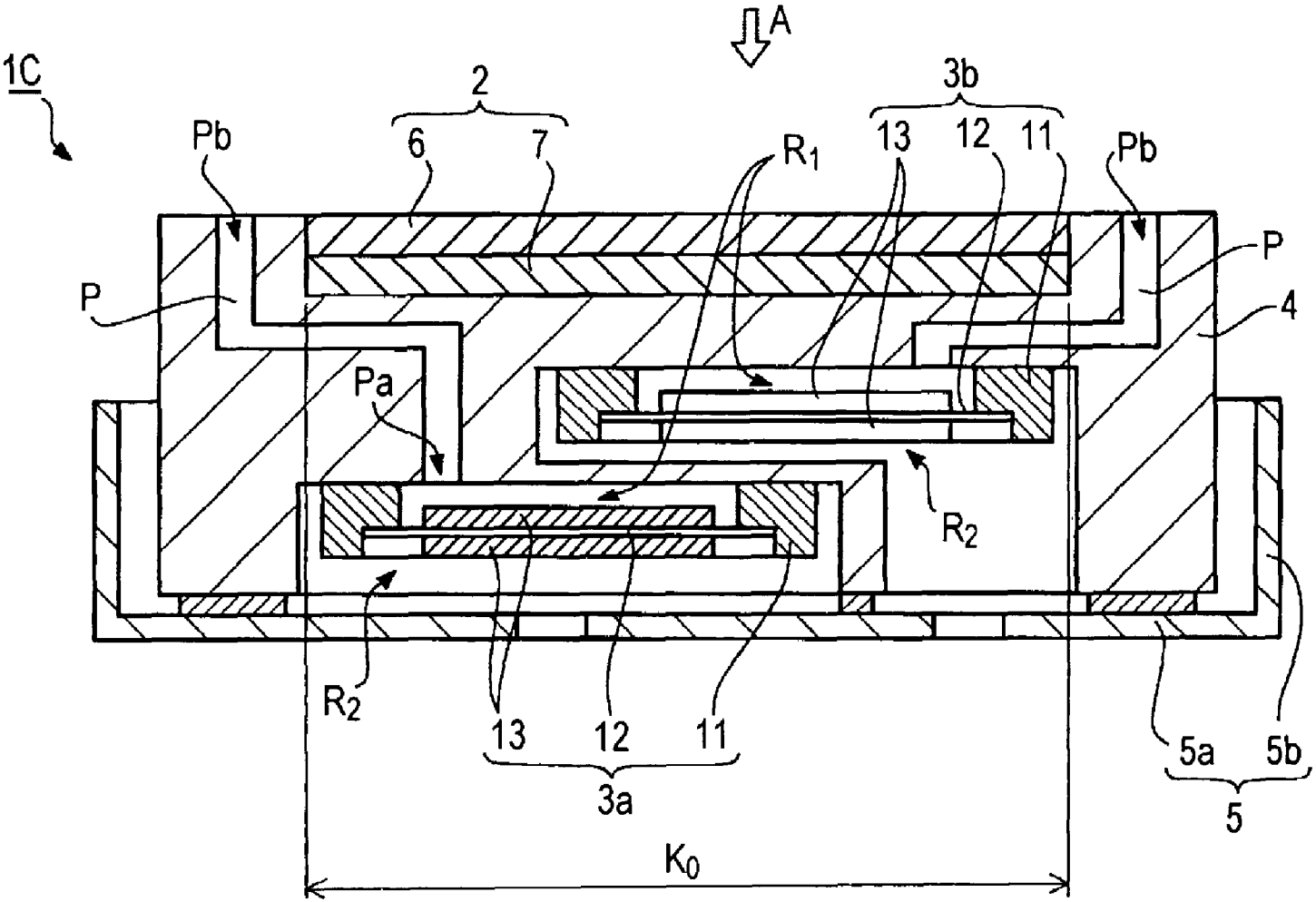
FIG. 5 is a cross-sectional view showing an electro-optical device according to still another embodiment of the invention.
Figure 6:
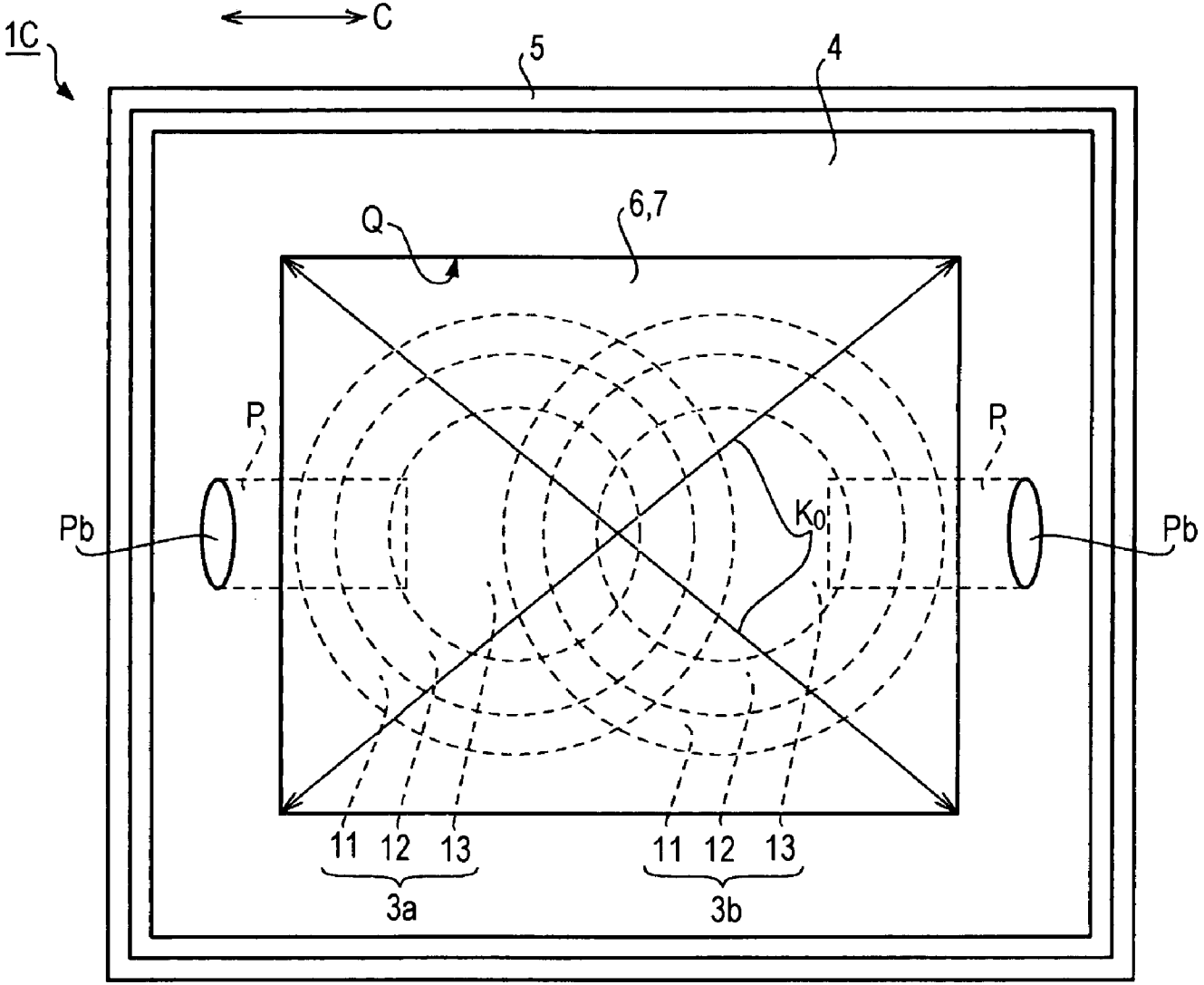
FIG. 6 is a plan view showing the electro-optical device as viewed from an arrow A of FIG. 5.

FIG. 5 shows an electro-optical device according to still another embodiment of the invention. In this embodiment, the same parts as those in the embodiment shown in FIG. 1 are represented by the same reference numerals, and thus the descriptions thereof will be omitted. In the electro-optical device 1A shown in FIG. 1, the speaker units 3*a* and 3*b* serving as the sound-production bodies are planarly arranged so as not to overlap each other. On the contrary, in an electro-optical device 1C shown in FIG. 5, two speaker units 3*a* and 3*b* are arranged so as to partially overlap each other. In a case of the electro-optical device 1C, as shown in FIG. 6, all the two speaker units 3*a* and 3*b* fall within the spatial region K0 in the vertical direction of the surface on the display region of the liquid crystal panel 6.

In FIG. 5, the inside of the first frame 4 has a stepped shape. One speaker unit 3*b* is provided at a step close to the liquid crystal display device 2 and the other speaker unit 3*a* is provided at a step away from the liquid crystal display device 2.

In this electro-optical device 1C, the two speaker units 3*a* and 3*b* are arranged so as to partially overlap each other, and thus the size in a widthwise direction (that is, a horizontal direction C of FIG. 6) of the electro-optical device can be further reduced, as compared with the case in which the two speaker units 3*a* and 3*b* are planarly arranged in the electro-optical device 1A of FIG. 1. Further, in the present embodiment, the speaker units 3*a* and 3*b* can be increased in size to fit in the longitudinal direction (that is, a vertical direction of FIG. 6) of the electro-optical device, as compared with the case in which the speaker units 3*a* and 3*b* are planarly arranged so as not to overlap each other in the electro-optical device of FIG. 1.

Fourth Embodiment of Electro-Optical Device

Figure 7:
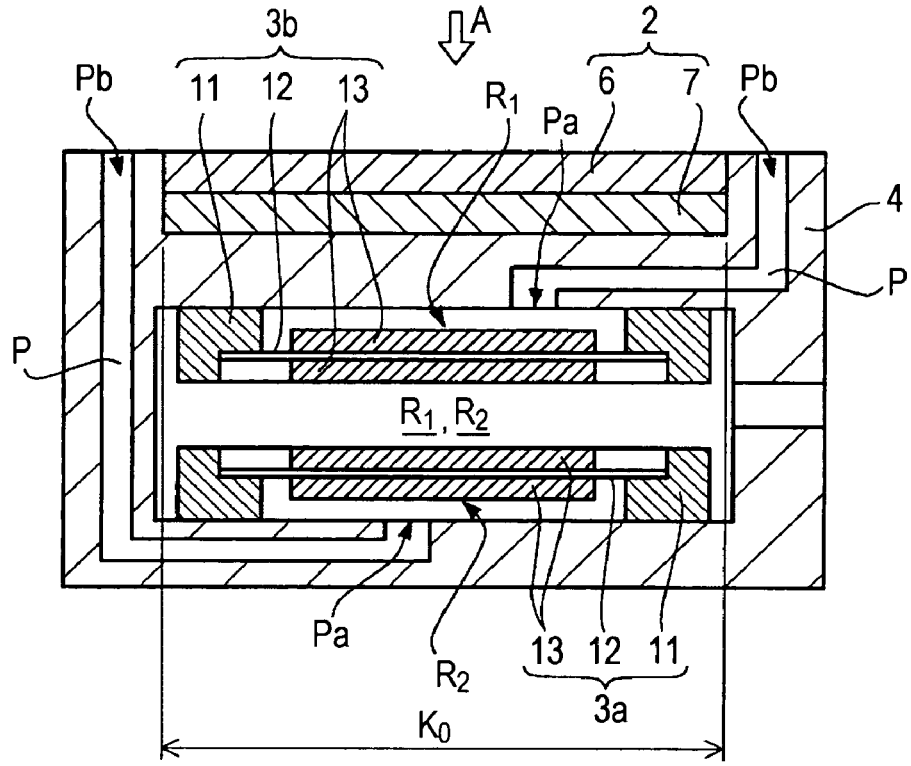
FIG. 7 is a cross-sectional view showing an electro-optical device according to a further embodiment of the invention.
Figure 8:
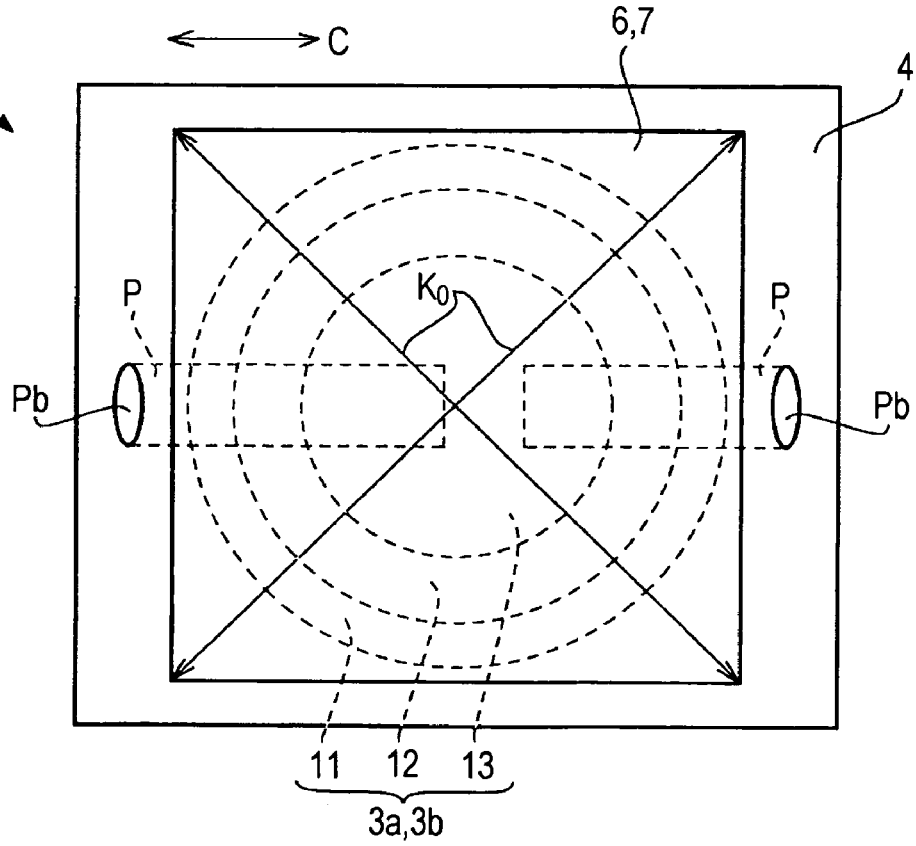
FIG. 8 is a plan view showing the electro-optical device as viewed from an arrow A of FIG. 7.

FIG. 7 shows an electro-optical device according to a further embodiment of the invention. In this embodiment, the same parts as those in the embodiment shown in FIG. 1 are represented by the same reference numerals, and thus the descriptions thereof will be omitted. In the electro-optical device 1C shown in FIG. 5, the two speaker units 3*a* and 3*b* serving as the sound-production bodies are arranged so as to partially overlap each other. On the contrary, in an electro-optical device 1D shown in FIG. 7, the two speaker units 3*a* and 3*b* are entirely arranged so as to overlap each other. In a case of the electro-optical device 1D, as shown in FIG. 8, all the two speaker units 3*a* and 3*b* fall within the spatial region K0 in the vertical direction of the surface on the display region of the liquid crystal panel 6.

In this electro-optical device 1D, all the two speaker units 3*a* and 3*b* are arranged so as to overlap each other, and thus the size in the widthwise direction (that is, a horizontal direction C of FIG. 8) of the electro-optical device can be further reduced, as compared with the case in which the speaker units 3*a* and 3*b* are planarly arranged so as not to overlap each other in the electro-optical device 1A of FIG. 1 or the case in which the two speaker units 3*a* and 3*b* are arranged so as to partially overlap each other in the electro-optical device 1C of FIG. 5.

Further, in the present embodiment, the speaker units 3*a* and 3*b* can be increased in size to fit in the longitudinal direction (that is, a vertical direction of FIG. 8) of the electro-optical device, as compared with the case in which the speaker units 3*a* and 3*b* are planarly arranged so as not to overlap each other in the electro-optical device 1A of FIG. 1 or the case in which the two speaker-units 3*a* and 3*b* are arranged so as to partially overlap each other in the electro-optical device 1C of FIG. 5.

Further, in the electro-optical device 1D of FIG. 7, all of the air spaces R1 near the display section and the air spaces R2 on the opposite side to the display section for the two speaker units 3*a* and 3*b* are formed by the first frame 4. Further, as for the speaker unit 3*a* away from the liquid crystal display device 2, one end Pa of the sound-guiding path P is connected to a portion of the air space R2 on the opposite side to the liquid crystal display device 2 and the other end Pb opens at the observation surface to form the sound-releasing hole. Further, as for the speaker unit 3*b* close to the liquid crystal display device 2, one end Pa is connected to a portion of the air space R1 near the liquid crystal display device 2 and the other end Pb opens at the observation surface to form the sound-releasing hole.

In the electro-optical device 1A of FIG. 1, the second frame 5 is required to form the air spaces R2 on the opposite side to the display section. When the second frame 5 is not used, any member of the electronic apparatus needs to be prepared to form the air spaces R2. On the contrary, in the electro-optical device 1D of FIG. 7, the air spaces R1 and R2 on both sides for the speaker units 3*a* and 3*b* are formed only by the first frame 4, and thus any member other than the first frame 4 is not required. By doing so, the electro-optical device can be further reduced in size.

Moreover, when the electro-optical device 1D of FIG. 7 is assembled into an electronic apparatus, such as a cellular phone, a portable information terminal, an IC recorder, or the like, the first frame 4 may be fixed to a case, a machine case, or the like of the electronic apparatus. At this time, the air spaces R1 and R2 are provided in advance by means of the first frame 4 under an appropriate condition, and thus condition setting relating to the air spaces of the electronic apparatus does not need to be performed. However, when the electro-optical device 1D is assembled into the electronic apparatus, like the second frame 5 shown in FIG. 1, the second frame 5 may be used so as to externally surround the respective parts of the first frame 4 and the speaker units 3*a* and 3*b* due to work necessity and structural necessity.

Other Embodiments of Electro-Optical Device

As described above, the invention has been described by way of the preferred embodiments, but the invention is not limited to the embodiments. Various changes can be made within the scope of the invention as defined by the appended claims.

For example, in the above-described embodiments, the liquid crystal display device is used as the display section of the electro-optical device, but, instead of the liquid crystal display device, for example, an electroluminescent (EL) display device, a plasma display device, or the like can be used. Further, each of the speaker units 3*a* and 3*b* shown in FIG. 1 has the vibrator 12 and the piezoelectric element 13, but the sound-production body is not limited to such a speaker unit and, if necessary, the speaker units having various structures can be used.

First Embodiment of Electronic Apparatus

Figure 9:
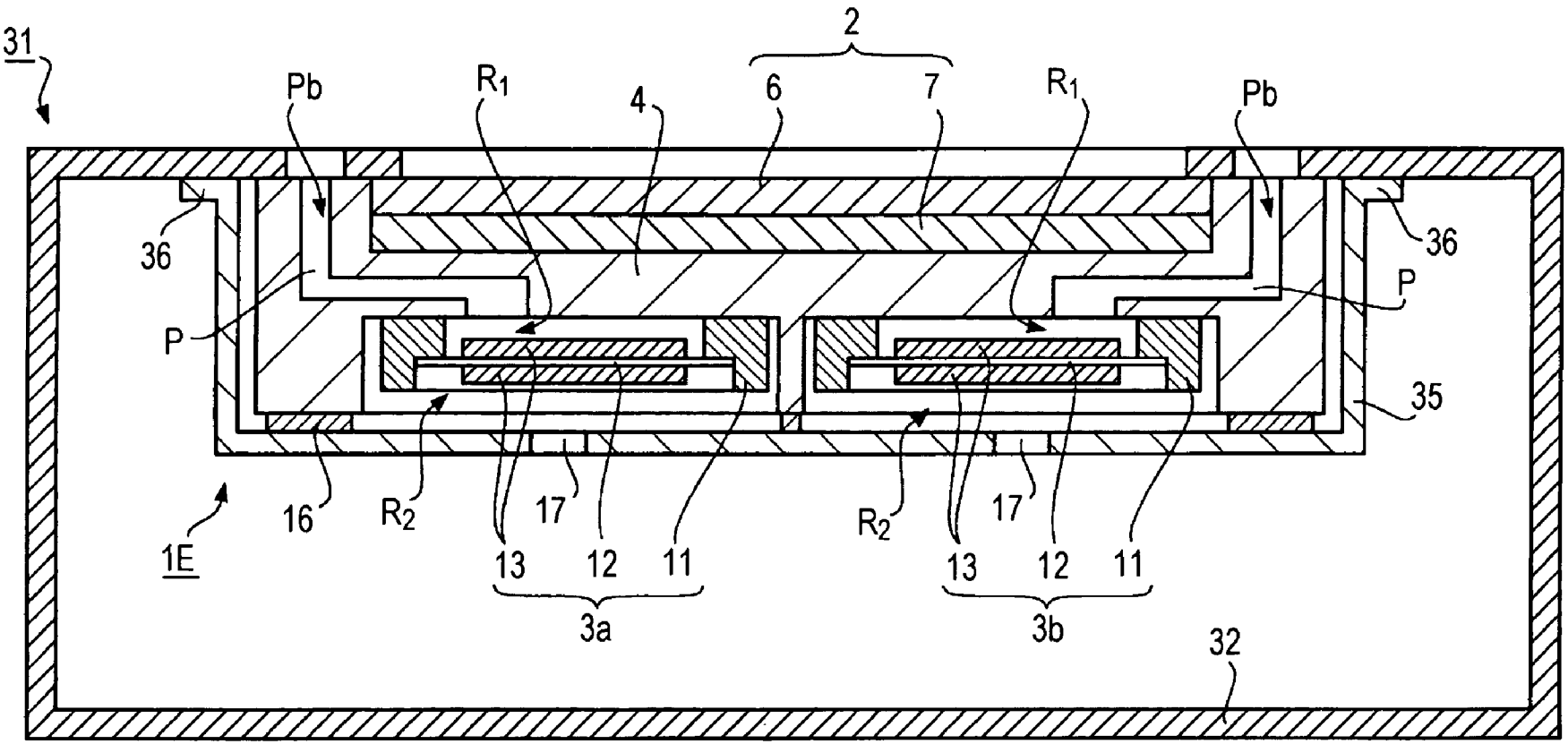
FIG. 9 is a cross-sectional view showing an electronic apparatus according to an embodiment of the invention.

FIG. 9 shows an electronic apparatus according to an embodiment of the invention. An electronic apparatus 31 shown in FIG. 9 has a case 32 serving as a fixed member and an electro-optical device 1E that is attached to the case 32. For example, the electronic apparatus 31 may be a cellular phone, a portable information terminal, an IC recorder, or any other apparatus, and the case 32 may be a packaging case of the apparatus, a machine frame provided in the packaging case, or any structure of the electronic apparatus that is provided as occasion demands. Moreover, if the case 32 is constituted by any part that is generally used in the typical electronic apparatus, favorably, a special member for fixing the electro-optical device does not need to be prepared.

It is assumed that the electro-optical device 1E substantially has the same configuration as that of the electro-optical device 1A shown in FIG. 1. The electro-optical device 1E is different from the electro-optical device 1A of FIG. 1 in that a second frame 35, instead of the second frame 5, is provided. All other parts are the same.

The second frame 35 shown in FIG. 9 has a shape in which the side walls 5*b* of the second frame 5 shown in FIG. 1 extend upward. More specifically, side walls of the second frame 35 are formed such that the upper ends thereof are approximately equal to the display surface of the liquid crystal panel 6, preferably, the upper ends thereof are disposed to be slightly lower than the display surface of the liquid crystal panel 6. Further, the upper ends of the side walls of the second frame 35 are partially bent in a horizontal direction, if necessary, to form flanges 36. Then, the second frame 35 comes in contact with the inner surface of the case 32 through the flanges 36.

The second frame 35 is fixed to the case 32 by an appropriate fixing method, for example, adhesion, screw fixing, press-fit bonding, engagement, caulking, or the like, in a state in which the flanges 36 come in contact with the case 32. At this time, the liquid crystal display device 2, the first frame 4, and the buffing member 16 are housed in the second frame 5 in the biased state, that is, under stress. If such a biased state is realized, the liquid crystal display device 2, the first frame 4, and the speaker units 3*a* and 3*b* can be reliably fixed in the electronic apparatus 31.

In the electronic apparatus 31 of the present embodiment, the liquid crystal display device 2, the first frame 4, and the speaker units 3*a* and 3*b*, which are the parts of the electro-optical device 1E, are integrally combined with one another, and, at this time, the air spaces R1 and R2 for the speaker units 3*a* and 3*b* are formed in advance by the first frame 4 and the second frame 5. For this reason, when the electro-optical device 1E is assembled into the case 32, the electro-optical device 1E having the integrated structure can be simply attached at an appropriate place in the case 32. By doing so, the entire shapes of the electro-optical device 1E and the electronic apparatus can be reduced in size and thickness, as compared with the case in which the liquid crystal display device 2 and the speaker units 3*a* and 3*b* are assembled separately into the case 32.

Second Embodiment of Electronic Apparatus

Figure 10:
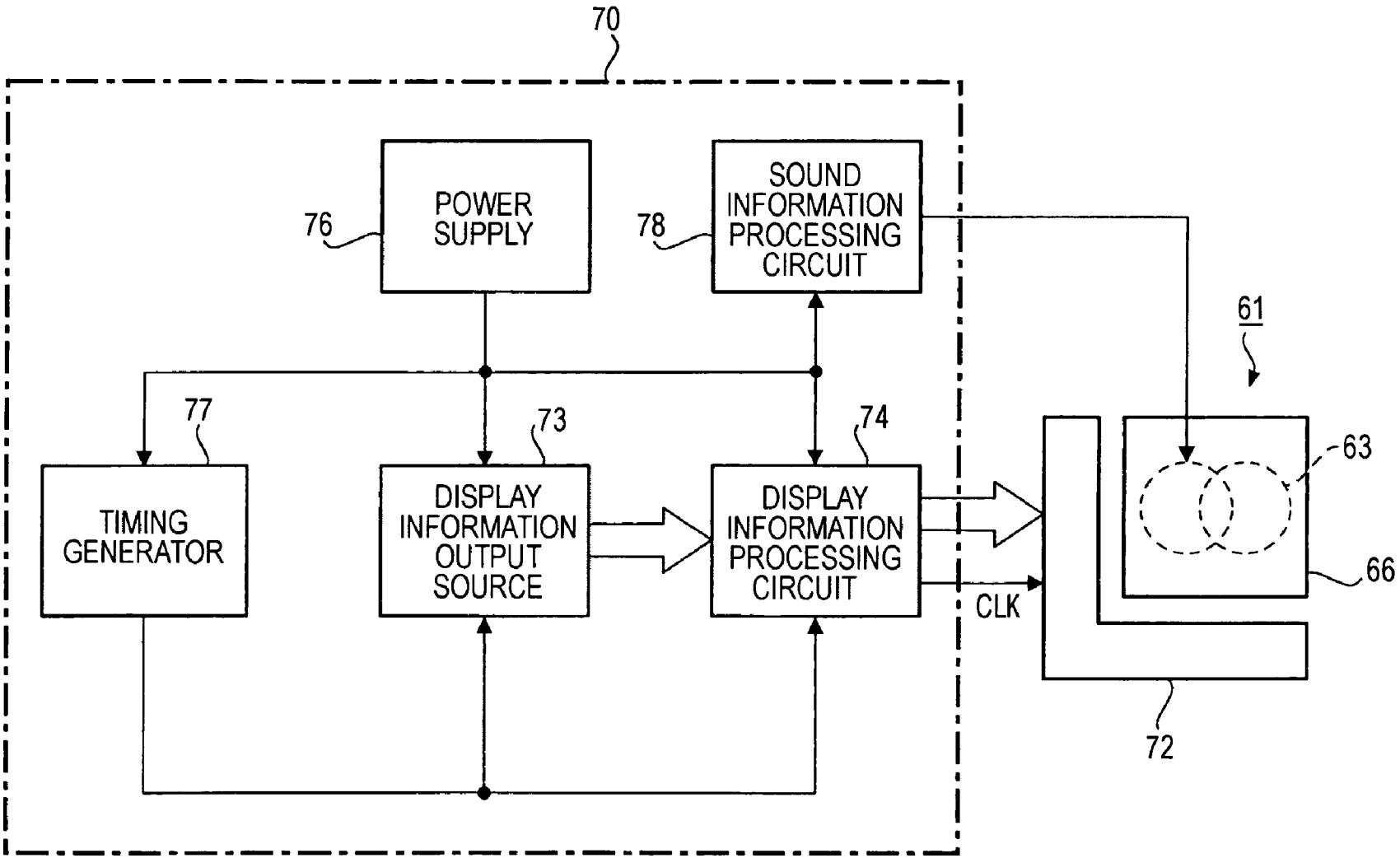
FIG. 10 is a block diagram showing an electronic apparatus according to another embodiment of the invention.

FIG. 10 shows a block diagram of an electronic apparatus according to another embodiment of the invention. The electronic apparatus shown in FIG. 10 has an electro-optical device 61 and a control circuit 70 that controls the electro-optical device 61. The electro-optical device 61 has a liquid crystal panel 66 serving as an electro-optical panel, a driving circuit 72 that has a semiconductor IC or the like, and speaker units 63. In this case, a plurality of speaker units 63 are provided.

The control circuit 70 has a display information output source 73, a display information processing circuit 74, a power supply circuit 76, a timing generator 77, and a sound information processing circuit 78. The display information output source 73 has a memory that has a ROM (Read Only Memory) or a RAM (Random Access Memory), a storage unit that has a magnetic recording disc, an optical recording disc, or the like, and a tuning circuit that synchronously outputs digital image signals. The display information output source 73 is constituted to supply display information to the display information processing circuit 74 in a shape of an image signal having a predetermined format based on various clock signals generated by the timing generator 77.

The display information processing circuit 74 includes various known circuits, such as a serial-parallel conversion circuit, an amplification/inversion circuit, a rotation circuit, a gamma correction circuit, a clamping circuit, and the like. The display information processing circuit 74 processes the input display information and supplies resultant image information to the driving circuit 72, together with a clock signal CLK. The driving circuit 72 includes a scanning line driving circuit, a data line driving circuit, and a test circuit. Further, the power supply circuit 76 supplies predetermined power to the respective parts described above. The sound information processing circuit 78 transmits sound signals to the speaker units 63 to cause the speaker units 63 to generate sound.

The electro-optical device 61 can be constituted by, for example, the electro-optical device 1A of FIG. 1, the electro-optical device 1B shown in FIG. 4, the electro-optical device 1C shown in FIG. 5, the electro-optical device 1D shown in FIG. 7, or the like. Of these electro-optical devices, for example, in the electro-optical device of FIG. 1, the liquid crystal display device 2 serving as the display section, the first frame 4, and the speaker units 3*a* and 3*b* serving as the sound-production bodies are integrally combined with one another. At this time, the air spaces R1 near the display section for the speaker units 3*a* and 3*b* are formed in advance by means of the first frame 4. For this reason, when the electro-optical device 1A is assembled into the electronic apparatus, the electro-optical device 1A having the integrated structure can be simply attached at the appropriate place in the electronic apparatus. By doing so, the entire shape of the electro-optical device 1A can be reduced in size and thickness, as compared with the case in which the liquid crystal display device 2 and the speaker units 3*a* and 3*b* are assembled separately into the electronic apparatus. As the shape of the electro-optical device 1A is reduced in size and thickness, the entire shape of the electronic apparatus can be reduced in size and thickness.

Third Embodiment of Electronic Apparatus

Figure 11:
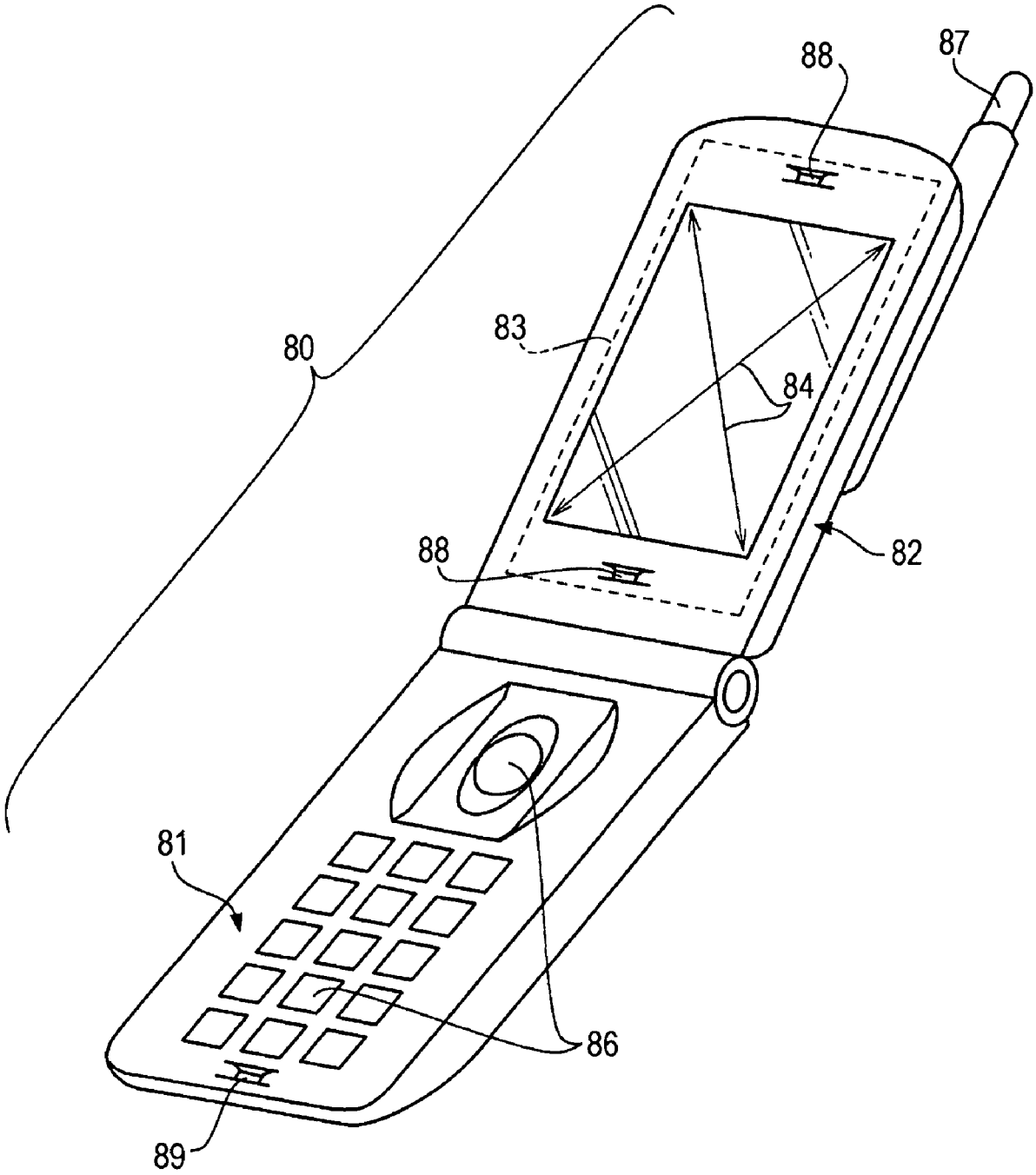
FIG. 11 is a perspective view showing an electronic apparatus according to still another embodiment of the invention.

FIG. 11 shows a cellular phone which is an example of the electronic apparatus according to the invention. A cellular phone 80 shown in FIG. 11 has a main body unit 81 and a display body unit 82 that is foldably provided to the main body unit 81. Inside the display body unit 82, an electro-optical device 83 is disposed, and various kinds of display relating to telephone communication can be viewed through a display screen 84 of the display body unit 82. In the main body unit 81, operating buttons 86 are arranged.

At one end of the display body unit 82, an antenna 87 is stretchably provided. Inside a receiver 88 provided in an upper portion of the display body unit 82, a speaker (not shown) is disposed. Further, inside a transmitter 89 provided at a lower end of the main body unit 81, a microphone (not shown) is incorporated. A control unit that controls the operation of the electro-optical device 83 is incorporated into the main body unit 81 and the display body unit 82 as a part of a control unit, which controls the entire cellular phone, or an additional part.

The electro-optical device 83 may be constituted by, for example, the electro-optical device 1A of FIG. 1, the electro-optical device 1B shown in FIG. 4, the electro-optical device 1C shown in FIG. 5, the electro-optical device 1D shown in. FIG. 7, or the like. In this case, for example, the sound-releasing hole Pb is disposed at a position corresponding to the receiver 88 shown in FIG. 11. As a fixed member for fixing the electro-optical device in the cellular phone 80, a packaging case of the cellular phone 80, an appropriate case in the packaging case, an appropriate frame in the packaging case, or the like can be used.

As for the above-described electro-optical device, for example, as shown in FIG. 1, the liquid crystal display device 2 serving as the display section, the first frame 4, and the speaker units 3*a* and 3*b* are integrally combined with one another. At this time, the air spaces R1 near the display section for the speaker units 3*a* and 3*b* are formed in advance by means of the first frame 4. For this reason, when the electro-optical-device 1A is assembled into the electronic apparatus, the electro-optical device 1A having the integrated structure can be simply attached at the appropriate place in the electronic apparatus. By doing so, the entire shape of the electro-optical device 1A can be reduced in size and thickness, as compared with the case in which the liquid crystal display device 2 and the speaker units 3*a* and 3*b* are assembled separately into the electronic apparatus. As the shape of the electro-optical device 1A is reduced in size and thickness, the entire shape of the cellular phone 80 can be reduced in size and thickness.

Other Embodiments of Electronic Apparatus

As described above, the invention has been described by way of the preferred embodiments, but the invention is not limited to the embodiments. Various changes can be made within the scope of the invention as defined by the appended claims.

For example, the electronic apparatus according to the invention includes, in addition to the above-described cellular phone, a personal computer, a liquid crystal television, a digital still camera, a wrist watch, a view finder-type or monitor-direct-view-type video tape recorder, a car navigation device, a pager, an electronic organizer, an electronic calculator, a word processor, a workstation, a video phone, a POS terminal, or any other apparatus.

The electro-optical device according to the invention is suitably used for a display device when various kinds of display are preformed in the cellular phone, the portable information terminal, the IC recorder, or any other electronic apparatus. In particular, the electro-optical device according to the invention is suitably used for an apparatus, which performs both image display and sound display. Further, the electronic apparatus according to the invention is used as a public apparatus, such as a cellular phone, a portable information terminal, an IC recorder, or the like, or an industrial apparatus, such as a measuring instrument or the like.

What is claimed is:

1. An electro-optical device comprising:

a display section that has a display region;

a plurality of sound-production bodies that are disposed to overlap the display section and produce sound, the plurality of sound-production bodies being arranged in a planar direction relative to one another so as not to overlap each other; and a first frame that is disposed between the display section and the sound-production bodies and that holds the display section, the first frame forming air spaces for the plurality of sound-production bodies, the first frame being formed with both a sound-guiding path and a sound-releasing hole for each of the plurality of sound-production bodies.

2. The electro-optical device according to claim 1, wherein the sound-production bodies are supported by the first frame.

3. The electro-optical device according to claim 1, further comprising a second frame that separately supports the sound-production bodies and the first frame on an opposite side of the display section with respect to the sound production bodies.

4. The electro-optical device according to claim 3, wherein the second frame forms an air space on an opposite side to the display section in the air spaces for the plurality of sound-production bodies.

5. The electro-optical device according to claim 3, wherein the second frame has a container shape that houses the display section, the first frame, and the sound-production bodies.

6. The electro-optical device according to claim 3, further comprising a third frame that clamps the first frame in a pressed manner together with the second frame.

7. The electro-optical device according to claim 1, wherein the sound-releasing holes open at the same surface as the display region of the display section.

8. An electronic apparatus comprising:

the electro-optical device according to claim 1; and a fixed member to which the electro-optical device is attached.

9. The electronic apparatus according to claim 8, wherein the fixed member is a packaging case.

10. The electro-optical device according to claim 1, further comprising a second frame that supports the first frame on an opposite side of the display section with respect to the sound-production bodies.

* * * * *